US009026445B2

(12) United States Patent
Niemeyer et al.

(10) Patent No.: US 9,026,445 B2
(45) **Date of Patent: *May 5, 2015**

(54) TEXT-TO-SPEECH USER'S VOICE COOPERATIVE SERVER FOR INSTANT MESSAGING CLIENTS

(71) Applicant: Nuance Communications, Inc., Burlington, MA (US)

(72) Inventors: Terry Wade Niemeyer, Austin, TX (US); Liliana Orozco, Del Valle, TX (US)

(73) Assignee: Nuance Communications, Inc., Burlington, MA (US)

( * ) Notice: Subject to any disclaimer, the term of this patent is extended or adjusted under 35 U.S.C. 154(b) by 39 days.

This patent is subject to a terminal disclaimer.

(21) Appl. No.: 13/847,850

(22) Filed: Mar. 20, 2013

(65) Prior Publication Data

US 2013/0218569 A1 Aug. 22, 2013

Related U.S. Application Data

(63) Continuation of application No. 13/494,164, filed on Jun. 12, 2012, now Pat. No. 8,428,952, which is a continuation of application No. 11/242,661, filed on Oct. 3, 2005, now Pat. No. 8,224,647.

(51) Int. Cl.
*G10L 13/08* (2013.01)
*G10L 13/00* (2006.01)
(Continued)

(52) U.S. Cl.
CPC ..... *G10L 13/02* (2013.01); *G10L 13/08* (2013.01); *G10L 13/04* (2013.01); *G10L 13/06* (2013.01); *G10L 13/00* (2013.01)

(58) Field of Classification Search
CPC ..... G10L 13/08; G10L 13/00; G10L 13/02; G10L 13/04; G10L 13/06
See application file for complete search history.

(56) References Cited

U.S. PATENT DOCUMENTS 5,278,943 A 1/1994 Gasper et al.
5,444,768 A 8/1995 Lemaire et al.
(Continued)

FOREIGN PATENT DOCUMENTS

EP 0 930 767 A2 7/1999
JP 05-260082 A 10/1993
(Continued)

OTHER PUBLICATIONS

East Bay Technologies, "IM Speak! Version 3.8," http://www.eastbaytech.com, downloaded Jul. 13, 2005, 1 page.
(Continued)

*Primary Examiner* — Matthew Baker
(74) *Attorney, Agent, or Firm* — Wolf, Greenfield & Sacks, P.C.

(57) ABSTRACT

A system and method to allow an author of an instant message to enable and control the production of audible speech to the recipient of the message. The voice of the author of the message is characterized into parameters compatible with a formative or articulative text-to-speech engine such that upon receipt, the receiving client device can generate audible speech signals from the message text according to the characterization of the author's voice. Alternatively, the author can store samples of his or her actual voice in a server so that, upon transmission of a message by the author to a recipient, the server extracts the samples needed only to synthesize the words in the text message, and delivers those to the receiving client device so that they are used by a client-side concatenative text-to-speech engine to generate audible speech signals having a close likeness to the actual voice of the author.

14 Claims, 9 Drawing Sheets

(51) Int. Cl.

| | |
|---|---|
| ***G10L 13/06*** | (2013.01) |
| ***G10L 13/02*** | (2013.01) |
| *G10L 13/04* | (2013.01) |

(56) References Cited

U.S. PATENT DOCUMENTS

| | | | | |
|---|---|---|---|---|
| 5,559,927 | A | 9/1996 | Clynes | |
| 5,812,126 | A | 9/1998 | Richardson et al. | |
| 5,860,064 | A | 1/1999 | Henton | |
| 5,890,115 | A * | 3/1999 | Cole | 704/258 |
| 5,995,590 | A | 11/1999 | Brunet et al. | |
| 6,023,678 | A | 2/2000 | Lewis et al. | |
| 6,035,273 | A | 3/2000 | Spies | |
| 6,100,461 | A * | 8/2000 | Hewitt | 84/603 |
| 6,125,346 | A | 9/2000 | Nishimura et al. | |
| 6,557,026 | B1 | 4/2003 | Stephens, Jr. | |
| 6,570,983 | B1 | 5/2003 | Speeney et al. | |
| 6,611,802 | B2 | 8/2003 | Lewis et al. | |
| 6,801,931 | B1 | 10/2004 | Ramesh et al. | |
| 6,810,379 | B1 | 10/2004 | Vermeulen et al. | |
| 6,816,578 | B1 | 11/2004 | Kredo et al. | |
| 6,862,568 | B2 | 3/2005 | Case | |
| 6,865,533 | B2 | 3/2005 | Addison et al. | |
| 6,925,437 | B2 | 8/2005 | Hayashi | |
| 7,027,568 | B1 | 4/2006 | Simpson et al. | |
| 7,043,436 | B1 | 5/2006 | Ryu | |
| 7,269,561 | B2 | 9/2007 | Mukhtar et al. | |
| 7,277,855 | B1 | 10/2007 | Acker et al. | |
| 7,280,968 | B2 | 10/2007 | Blass | |
| 7,313,522 | B2 | 12/2007 | Fukuzato | |
| 7,483,832 | B2 | 1/2009 | Tischer | |
| 7,693,719 | B2 | 4/2010 | Chu et al. | |
| 7,706,510 | B2 | 4/2010 | Ng | |
| 7,865,365 | B2 | 1/2011 | Anglin et al. | |
| 8,224,647 | B2 | 7/2012 | Niemeyer et al. | |
| 2002/0099547 | A1 * | 7/2002 | Chu et al. | 704/260 |
| 2003/0028380 | A1 | 2/2003 | Freeland et al. | |
| 2003/0120492 | A1 | 6/2003 | Kim et al. | |
| 2003/0219104 | A1 | 11/2003 | Malik | |
| 2004/0054534 | A1 | 3/2004 | Junqua | |
| 2004/0088167 | A1 | 5/2004 | Sartini | |
| 2004/0111271 | A1 | 6/2004 | Tischer | |
| 2004/0148171 | A1 * | 7/2004 | Chu et al. | 704/258 |
| 2004/0225501 | A1 | 11/2004 | Cutaia | |
| 2005/0027539 | A1 | 2/2005 | Weber et al. | |
| 2005/0043951 | A1 | 2/2005 | Schurter | |
| 2005/0071163 | A1 | 3/2005 | Aaron et al. | |
| 2005/0074132 | A1 | 4/2005 | Lemoine et al. | |
| 2005/0096909 | A1 | 5/2005 | Bakis et al. | |
| 2005/0131706 | A1 * | 6/2005 | Teunen et al. | 704/273 |
| 2005/0149330 | A1 | 7/2005 | Katae | |
| 2005/0187773 | A1 | 8/2005 | Filoche et al. | |
| 2006/0031073 | A1 | 2/2006 | Anglin et al. | |
| 2006/0069567 | A1 | 3/2006 | Tischer et al. | |
| 2006/0095265 | A1 | 5/2006 | Chu et al. | |
| 2007/0260461 | A1 | 11/2007 | Marple et al. | |
| 2008/0235024 | A1 | 9/2008 | Goldberg et al. | |
| 2012/0253816 | A1 | 10/2012 | Niemeyer et al. | |

FOREIGN PATENT DOCUMENTS

| | | | |
|---|---|---|---|
| JP | 2000-122941 | | 4/2000 |
| JP | 2001-0034280 | | 2/2001 |
| JP | 2005-031919 | | 2/2005 |
| JP | 2005-535012 | A | 11/2005 |
| WO | WO 02/084643 | A1 | 10/2002 |
| WO | WO 2004/012151 | A1 | 2/2004 |

OTHER PUBLICATIONS

Lemmetty, S., "Review of Speech Synthesis Technology," Helsinki University of Technology, Department of Electrical and Communications Engineering, http://www.acoustics.hut.fi/~slemmett/dippa/index.html, downloaded Jul. 14, 2005.

"Method for Text Annotation Play Utilizing a Multiplicity of Voices," *IBM Technical Disclosure Bulletin* 36(6B):Jun. 9-10, 1993, https://www.delphion.com/tdbs/tdb?order=93A+61428.

Office Action in Japanese Patent Application No. 2006-270009 mailed Jan. 4, 2012.

Office Action mailed Aug. 21, 2009 in Chinese Patent Application No. 2006100935550.

Search Mobile Computing.com, "Text-to-speech," http://www.searchmobilecomputing.techtarget.com/sdefinition/0,29060.sid4, downloaded Jul. 24, 2005.

Singer, M., "Teach Your Toys to Speak IM," http://www.instantmessagingplanet.com, downloaded Jul. 13, 2005, 2 pages.

Tyson, J., "How Instant Messaging Works," How Stuff Works http://computer.howstufworks.com/instant-messaging/html/printable , downloaded Jul. 14, 2005.

Whatis.com, "Sable," http://whatis-techtarget.com/definition/0,sid9_gci833759.00html, downloaded Jul. 14, 2005.

Whatis.com, "Speech Synthesis," http://whatis-techtarget.com/definition/0,sid9_gci773595.00html, downloaded Jul. 14, 2005.

Office Action for Japanese patent application No. 2006-270009 mailed Aug. 28, 2012.

Appeal Decision for Japanese Patent Application No. 2006-270009 mailed Nov. 12, 2013.

* cited by examiner (b)

(a)

TEXT-TO-SPEECH USER'S VOICE COOPERATIVE SERVER FOR INSTANT MESSAGING CLIENTS

CROSS-REFERENCE TO RELATED APPLICATIONS

The present application claims the benefit under 35 U.S.C. §120 as a continuation of U.S. patent application Ser. No. 13/494,164, filed on Jun. 12, 2012 and entitled "TEXT-TO-SPEECH USER'S VOICE COOPERATIVE SERVER FOR INSTANT MESSAGING CLIENTS," which is a continuation of U.S. patent application Ser. No. 11/242,661 (now U.S. Pat. No. 8,224,647), filed Oct. 3, 2005 and entitled "TEXT-TO-SPEECH USER'S VOICE COOPERATIVE SERVER FOR INSTANT MESSAGING CLIENTS," which are hereby incorporated herein by reference in their entireties.

FEDERALLY SPONSORED RESEARCH AND DEVELOPMENT STATEMENT

This invention was not developed in conjunction with any Federally sponsored contract.

MICROFICHE APPENDIX

Not applicable.

INCORPORATION BY REFERENCE

None.

BACKGROUND OF THE INVENTION

1. Field of the Invention

This invention relates to a method that uses server-side storage of user's voice data for use by Instant Messaging clients for reading of text messages using text-to-speech synthesis.

2. Background of the Invention

Text-to-Speech Synthesis.

Traditional text-to-speech ("TTS") synthesizing methods can be classified into two main phases, high and low-level synthesis. High-level synthesis takes into account words and grammatical usage of those words (e.g. beginning or endings of phrases, punctuation such as periods or question marks, etc.). Typically, text analysis is performed so the input text can be transcribed into a phonetic or some other linguistic representation, and phonetic information creates the speech generation in waveforms.

During high-level TTS processing, a text string to be spoken is analyzed to break it into words. The words are then broken into smaller units of spoken sound referred to as "phonemes". Generally speaking, a phoneme is a basic, theoretical unit of sound that can distinguish words. Words are then defined or configured as collections of phonemes. Then, during low-level TTS, data is generated (or retrieved) for each phoneme, words are assembled, and phrases are completed.

Low-level synthesis actually generates data which can be converted into analog form using appropriate circuitry (e.g. sound card, D/A converter, etc.) to audible speech. There are three general methods for low-level TTS synthesis: (a) formant, (b) concatenative, and (c) articulatory synthesis.

Formant synthesis, also known as terminal analogy, models only the sound source and the formant frequencies. It does not use any human speech sample, but instead employs an acoustic model to create the synthesized speech output. Voicing, noise levels, and fundamental frequency are some of the parameters use over time to create a waveform of artificial speech.

Because formant synthesis generates more of a robotic-sounding speech, it does not have the naturalness of a real human's speech. One of the advantages of formant synthesized speech is its intelligence. It can avoid the acoustic glitches that often hinders concatenative systems even at high speeds. In addition, because formant-based systems have total control in its output speech, it can generate a variety of simulated emotions and voice tones.

Formant TTS synthesizing programs are smaller in size than concatenative systems, because it does not require a database of speech samples. Therefore, it can be use in situations where processor power and memory spaces are scarce.

The articulatory TTS synthesis approach models the human speech production directly, but without use of any actual recorded voice samples. Articulatory synthesis attempts to mathematically model the human vocal tract, and the articulation process occurring there. For these reasons, articulatory synthesis is often viewed as a more complex version of formant TTS synthesis.

Concatenative synthesis involves combining or "concatenating" a series of short, pre-recorded human voice samples to reproduce words, phrases and sentences, in a manner to have more human-like qualities. This method yields the most natural sounding synthesized speech. However, because of its natural variation, sometimes audible glitches plague its waveforms (e.g. clicks, pops, etc.), which reduces its naturalness. To speak a large vocabulary or dictionary, a concatenative TTS system also must have considerable data storage in order to hold all of the human voice samples. There are three subtypes of concatenative synthesis: unit selection, diphone, and domain-specific synthesis. All subtypes use pre-recorded words and phrases to create complete utterances depending on its methodologies.

To summarize, formant or articulatory TTS systems require less software and storage space, but do not yield a human-like voice having the character of any particular, real person. Formant TTS systems yield a voice sounding somewhat like the person from whom phoneme samples were taken, but these systems require considerably more storage space for the sample databases.

Text-Based Instant Messaging.

As the use of technology advances today, more people are using real-time messaging systems, such as America Online's ("AOL") Instant Messaging ("AIM")™, or International Business Machines' ("IBM") SameTime™, as a way to communicate via their computer with one or more parties in a near real-time manner.

Both email and IM are generally text-based. In other words, they usually are used to send text-only messages, as their operation with graphics, movies, sound, etc., are either limited, inefficient, or unavailable, depending on the service or network being used.

Real-time messaging systems differ from electronic mail ("e-mail") systems in that the messages are delivered immediately to the recipient, and if the recipient is not currently online, the message is not stored or queued for later delivery. With instant messaging, both (or all) users who are subscribers to the same service must be online at the same time in order to communicate, and the recipient(s) must also be willing to accept instant messages from the sender. An attempt to send a message to someone who is not online, or who is not willing to accept messages from a specific sender, will result in notification that the transmission can not be completed.

Thus, even though IM is generally text-based like e-mail, its communication, mechanism works more like a two-way radio or telephone than an e-mail system.

There are very few provisions in IM to assist users who are visually impaired. Text size, color and background can be adjusted to some degree. Additionally, some IM clients running on specific platforms, such as an IBM-compatible personal computer running Windows, can active a text-to-speech function which "speaks" text on the computer screen using a computer-like synthesized voice. This computer-like synthesized voice can be difficult to understand. Additionally, as the synthesized voice is the same tone and character for all text it reads, regardless of message author, the recipient of a message may find it difficult to determine who is sending IM messages to them.

Some new products have been introduced to enable sight-impaired people to communicate more effectively via IM. One such method is a completely client-based arrangement where the software allows the user to choose from several "stock" pre-recorded voices. The received text messages are audibly "read" using one of these voices to the receiver. The use hears the messages in the same voice and tone regardless of who originally sent the text messages. For example, if a user selects a male voice, that male voice will be used to read all messages, regardless of who authored the message, even if the author was female. Additionally, this type of formant-based TTS system requires storage space on the client device to hold the phoneme samples, which makes this system unattractive for low-cost, pervasive computing device use, such as personal digital assistants ("PDA"), smart phones, and the like.

Another approach offered currently in the market place is to couple a voice messaging system with an instant messaging system. If a message sender discovers that the intended recipient is not currently online, and thus cannot receive an IM message, the sender is given an opportunity to record a message in a voice mail system. The recorded voice message is then held for later retrieval by the intended recipient. This approach, however, doubles the effort required of the sender—first the sender must type a text message, then the sender must record a voice message. Additionally, this approach requires the intended recipient to use an interface besides the IM client—the recipient must somehow log into and retrieve a voice mail message.

Yet another attempt to address these issues has been to provide the client device of the IM message recipient with a capability to synthesize speech from IM message text with a user choice of assigning a particular "tone" of voice in the synthesizer based on the author of the message. This "tone" is not the tone or characteristic sound of the author, but instead is a computer-synthesized tone which can be used by the recipient to help differentiate between different authors of messages he or she receives.

Thus, the current instant text messaging technology lacks the intelligibly feature in enabling more effective communication for the sight-impaired users. None of these methods truly solves instant text messaging problem for the sight-impaired. Each of them exhibits one or more of the problems of requiring large amounts of code on the client device, requiring large amounts of sample storage on the client device, or failing to create speech which is similar in character and nature to that of a message sender or author.

SUMMARY OF THE INVENTION

The present invention allows an author or sender of an instant message to enable and control the production of audible speech to the recipient of the message. According to one aspect of the invention, the voice of the author of the message is characterized into parameters compatible with a formative or articulative text-to-speech engine such that upon receipt, the receiving client device can generate audible speech signals from the message text according to the characterization of the author's voice.

According to another aspect of the present invention, the author can store phonetic and word samples of his or her actual voice in a server. Upon transmission of a message by the author to a recipient, the server extracts the samples needed only to synthesize the words in the text message, and delivers those to the receiving client device so that they are used by a client-side concatenative text-to-speech engine to generate audible speech signals having a close likeness to the actual voice of the author.

According to yet another aspect of the present invention, instead of transmitting the actual formative or articulative control parameters, or instead of transmitting actual phoneme samples with the instant message, only hyperlinks or other pointers are transmitted along with the message. Then, upon "reading" the message by the recipient client device, the samples and/or parameters can be retrieved using the links.

BRIEF DESCRIPTION OF THE DRAWINGS

The following detailed description when taken in conjunction with the figures presented herein provide a complete disclosure of the invention.

DESCRIPTION OF THE INVENTION

Figure 1:
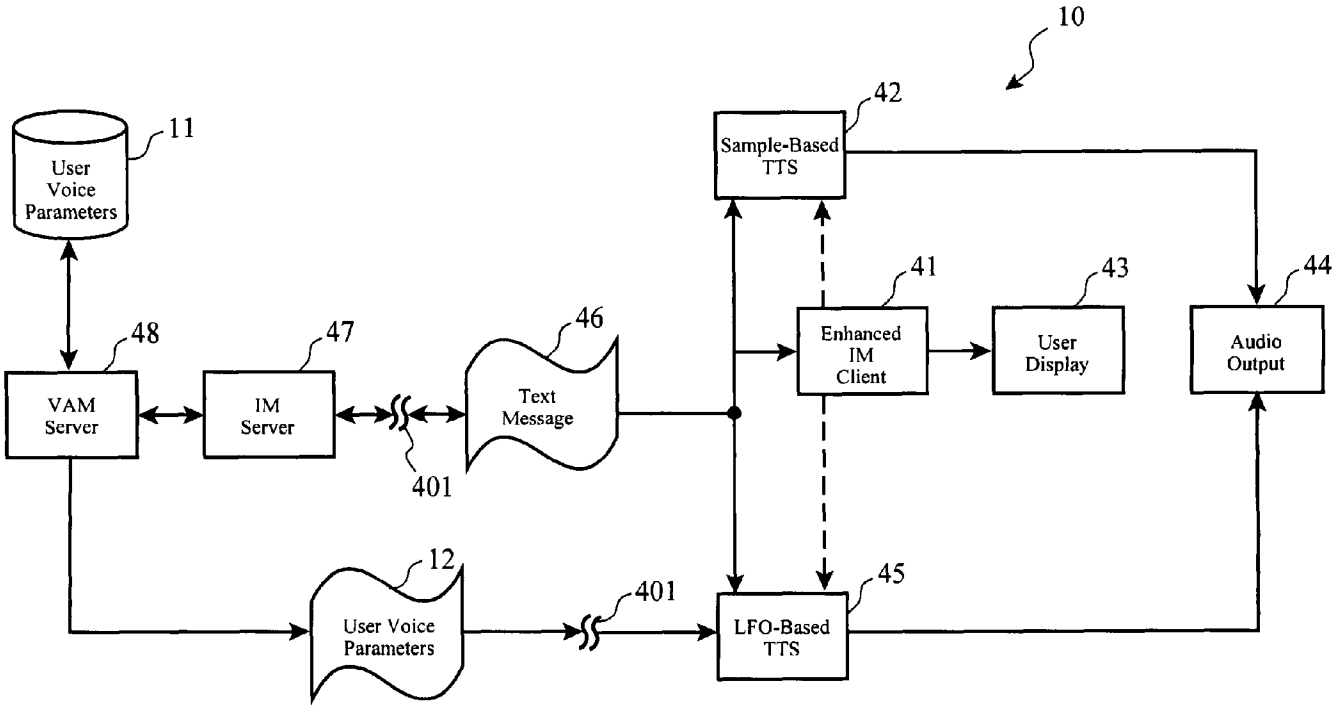
FIG. 1 illustrates one embodiment of the invention in which previously-configured LFO TTS synthesis parameters which cause TTS to closely resemble the voice of the author of an IM message are exchanged with the receiving client.

In the following disclosure, we will refer collectively to all TTS synthesis methods and systems which use a software-generated tone as a basis for speech generation (e.g. formative, articulative, etc.) as Local Frequency Oscillator ("LFO") TTS synthesis methods. These types of methods do not attempt to model or sound like any particular or specific human's voice, and often sound more like a "computer voice". They generally do not require voice sample storage, as they generate their speech almost entirely based upon mathematical models of speech and human vocal tracts.

Likewise, we will refer to all TTS synthesis methods and systems which rely upon sampled or recorded human voice for generation of a speech signal (e.g. concatenative) collectively as "Sample-based" TTS methods as systems.

The present invention is set forth in terms of alternate embodiments using LFO or sample-based TTS methods, or a combination of both, in a manner which minimizes resource requirements at the receiving client device, but maximizes the control of the author or sender of a message to determine the distinctive intelligible characteristics of the voice played to the recipient.

In a more general sense, the present invention provides server-side storage and/or analysis of the sender's voice, in order to alleviate the receiving client device from significant resource consumption of complex LFO-synthesis software or large amounts of voice sample storage for sample-based TTS. When a message is delivered to a client, the invention provides the receiving client device with one of several mechanisms to obtain or use only the amount of resources necessary to synthesize speech for the specific IM message.

For example, in a first embodiment, if LFO-based TTS is used by the receiving client device, a set of synthesis parameters which cause or control the ITS engine to generate a voice sounding similar to the message sender's own voice are sent along with the IM message. Thus, the receiving user does not have to define these parameters for each potential author, nor does the receiving client device have to consume resources (e.g. memory, disk space, etc.) to store long term a large number of parameters for a large number of potential authors of messages. By using this method, the receiving user is provided with a TTS which is distinctive and recognizable as the voice of the specific author of each message, and the sender or author of the message is not required to record a separate voice message in place of the text IM message.

In a second variant embodiment of the present invention, if sample-based TTS is used by the receiving client device, then a full set of phoneme samples for each message author is stored by a voice annotated messaging server, not by the client device. This alleviates the client device of dedicating large amounts of resources to storing phoneme samples for a large number of potential message authors from whom messages may be received. When the IM message is transmitted from the message server to the receiving client, the message is provided with a subset of phoneme samples which are determined to be required to synthesize the words and phrases contained in the text message. Phonemes which are not required for the specific message are not transmitted, and thus the data storage requirements at the client end are greatly minimized. The receiving client then temporarily stores this subset of phoneme samples until the receiving user has heard the speech, after which the samples may optionally be deleted. This approach also frees the sender from having to record a separate voice message to accompany the message, minimizes the size of the voice-annotated message during transmission, and allows the receiving user to hear synthesized voice according to the message text which close approximates the characteristics and distinctive nature of the sender's voice. Again, like the first embodiment, the receiving user is not required to configure TTS parameters for each potential author from whom messages may be received, and client device resource consumption for the TTS is reduced compared to available technologies.

In a third embodiment of the present invention operates similarly to the second embodiment just discussed, but instead of transmitting a subset of the phoneme samples with the IM message, only a set of pointers or hyperlinks to the server-side storage locations of the subset of phoneme samples is transmitted. This further reduces the size of the voice-annotated IM message, but allows the client device to quickly retrieve the phoneme samples as they are needed, potentially in real-time as the speech is being synthesized.

General Operation of the Invention

Figure 3:
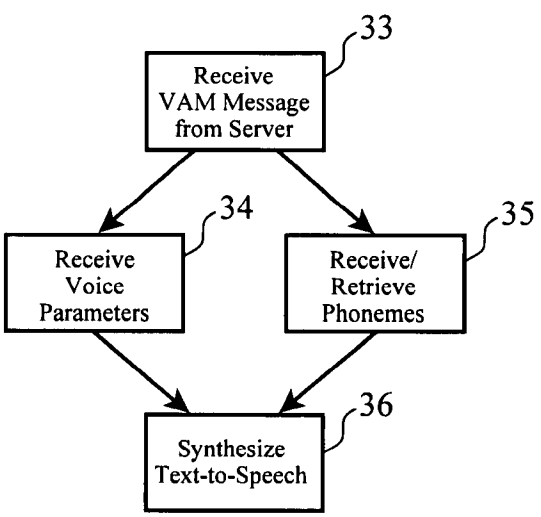
FIG. 3*a* illustrates a logical process according to the invention to author an IM message with voice annotation.
FIG. 3*b* illustrates a logical process according to the invention to receive and "play" such a voice-annotated IM message.
Figure 3:
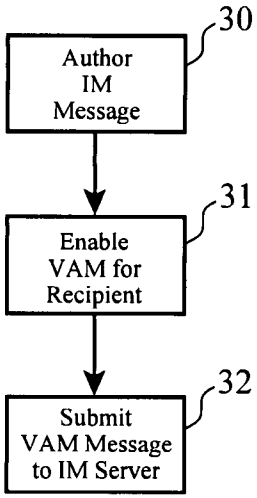

Turning to FIG. 3*a*, generally speaking, a user of the voice-annotated instant messaging system authors (30) a text message normally by typing text, then the author enables (31) voice-annotated reception by the intended recipient, and submits or "sends" (32) the specially controlled message to an instant message server which cooperates with a voice-annotate message server.

FIG. 3*b* illustrates the general operation of the invention for receipt of a voice-annotated instant message, in which a receiving user receives (33) the voice-annotated message from the server(s); the invention either receives (34) LFO-based voice synthesis parameters as controlled by the author/sender, receives (35) phoneme samples as controlled by the author/sender, or both; and then the text of the message is synthesized according to the parameters or samples controlled and configured by the author or sender of the message.

An LFO TTS-Based Embodiment

As previously discussed, a first embodiment (11) of the present invention interoperates with client devices which employ LFO-based TTS capabilities. Turning to FIG. 1, a set of voice synthesis parameters (11) for an author or sender are stored by a voice-annotated messaging ("VAM") server (48), which cooperates with an instant messaging server (47), such as an IBM Sametime™-based server. When the author creates and sends an instant message (46) containing a text portion, the VAM server also extracts the author's LFO synthesis parameters (12) from non-client storage (11), and provides (401) those extracted parameters (12) to the client-side LFO TTS engine (45). The method of providing (401) these parameters can vary among realizations of the invention, including but not limited to:

(a) attaching the parameters to the message (46) as a data section; and (b) placing a pointer or hyperlink in the message (46) which points to the storage location of the parameters on a client-accessible storage medium.

The enhanced IM client (41) can then control the LFO TTS engine to generate an audible voice signal (44) from the text of the message (46) and having the characteristics (12) determined by the sender or author of the message, in conjunction with the display (43) of the text portion of the message (46).

A Sample-Based TTS Embodiment

Figure 4:
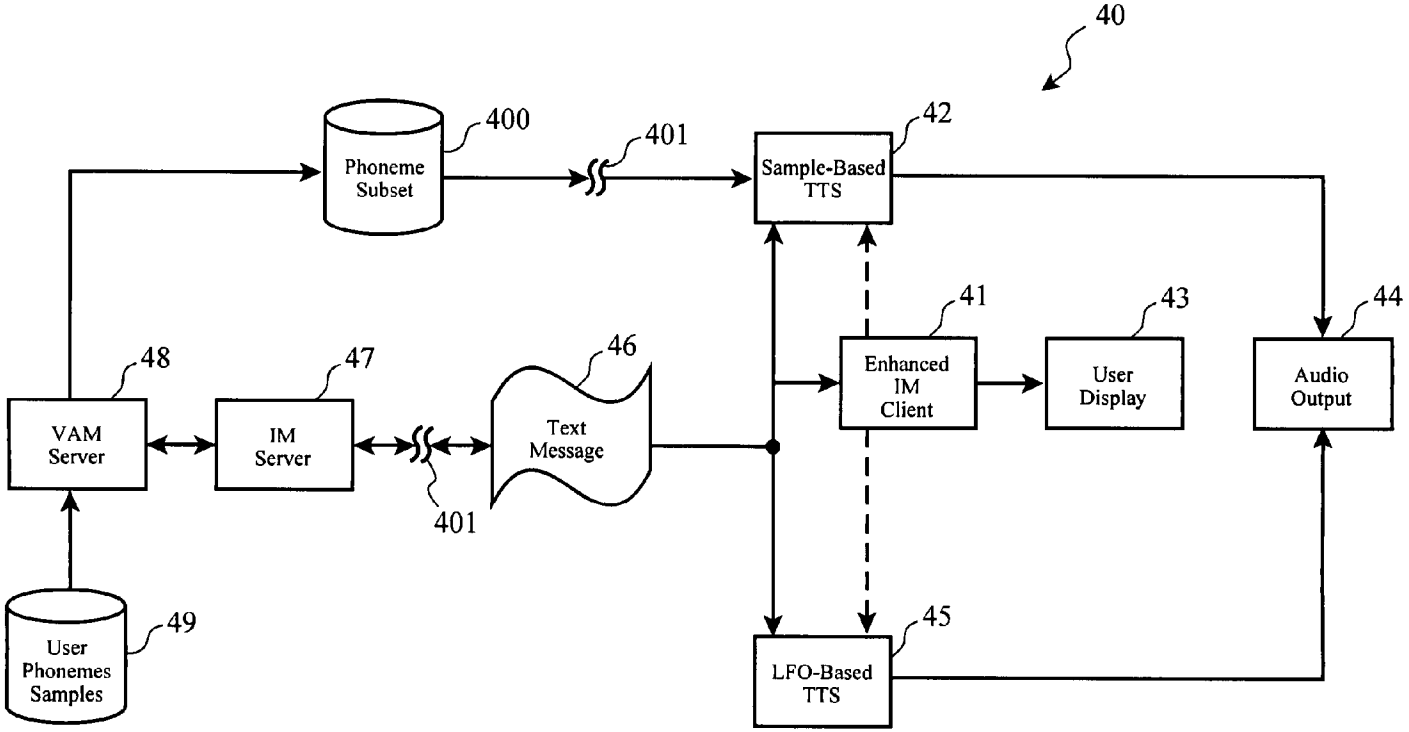
FIG. 4 illustrates another embodiment of the present invention utilizing the transmission of a subset of recorded user phonemes.
Figure 5:
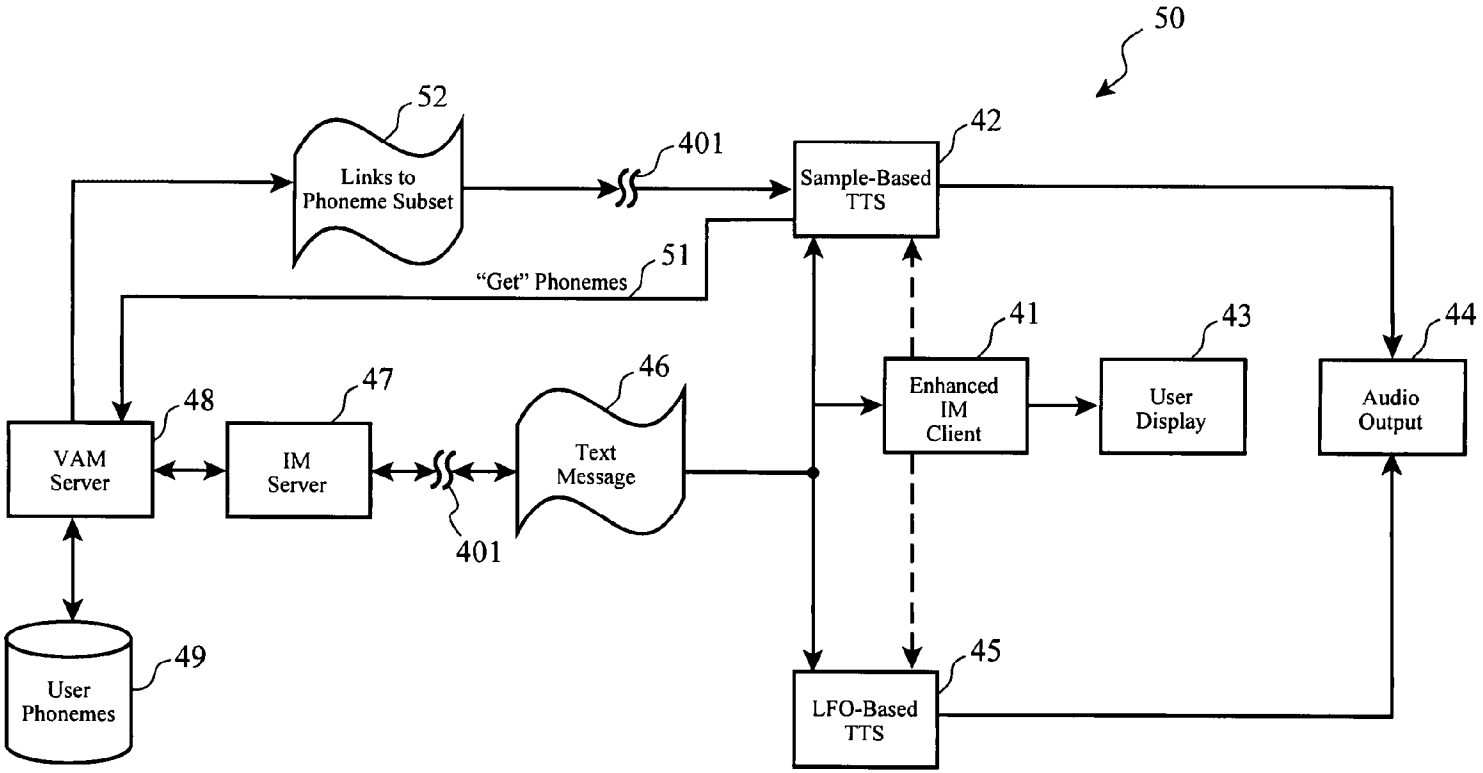
FIG. 5 shows yet another embodiment of the present invention utilizing the exchange of a set of hyperlinks which point to a subset of sampled user phonemes.

As previously discussed, another embodiment of the invention allows for interoperation with client devices which employ sample-based TTS technology, as shown in more detail in FIG. 4. In this embodiment, a full set of user phoneme samples is stored (49) by a VAM server (48), not by the client, for each author or sender of a message using the system. Then, when a IM text message (46) is created and sent by such a user, the VAM server analyzes the text content of the message (46), determines which phonemes are needed to synthesize a voice reading of the message, and which phonemes would not be used by the TTS engine for the particular text message (46). The needed or required subset of phoneme samples (400) is then extracted from storage (49) by the VAM server (48), and provided (401) to the client-side sample-based TTS engine (42). Similarly to the previously described LFO-based embodiment, the method used to provide (401) the subset of phoneme samples to the client-side TTS engine can vary according to the network and technology of a specific realization, including but not limited to:

(a) attaching or associating the samples (400) with the message (46); and (b) providing one or more pointers or hyperlinks (52) to the subset of samples stored on a client-accessible medium, such that the TTS engine can retrieve (51) the samples when needed, as shown in FIG. 5.

Sender/Author Account Initialization

Figure 8:
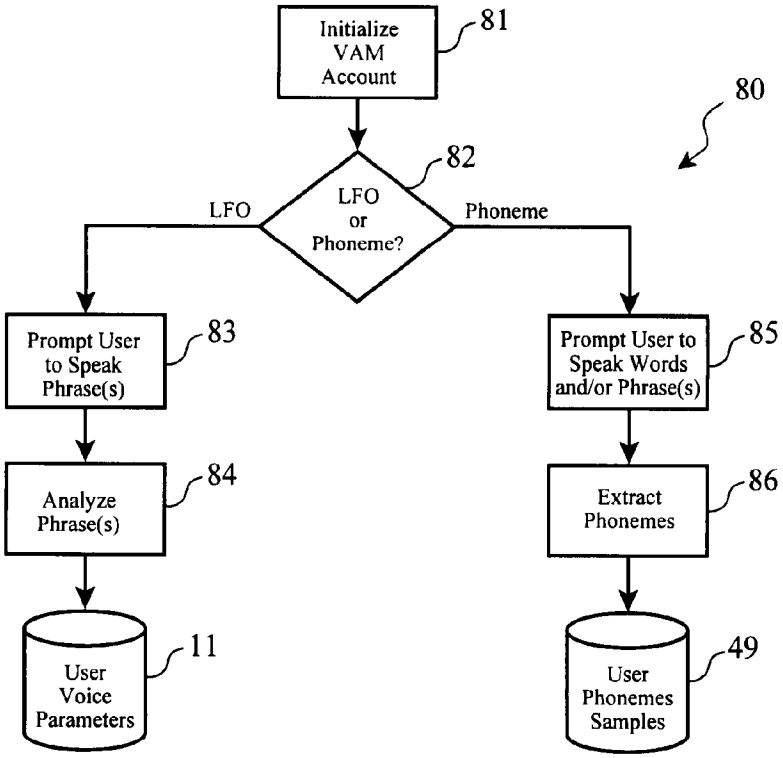
FIG. 8 sets forth a logical process according to the present invention for allowing a user to initialize one or both methods of initializing their authoring account.

Turning to FIG. 8, a generalized process according to the invention of initializing the system for each user who wishes to author and send voice-annotated messages is shown. The author (81) preferably logs into a web page, calls a voice response unit ("VRU"), or takes similar action to start (81) the initialization (or maintenance) process (80), and then chooses (82) to initialize LFO or sample-based operation, or both.

If the user chooses to initialize (or update) LFO-based TTS operation, generally, the user is prompted to speak words and phrases (83), which are then analyzed (84) to generate LFO synthesis parameters, which are then stored (11) in association with the user's account or identity.

If the user chooses to initialize (or update) sample-based TTS operation, generally, the user is prompted to speak words and phrases (85), which are then analyzed (86) to extract phoneme samples, which are then stored (49) in association with the user's account or identity.

Figure 6:
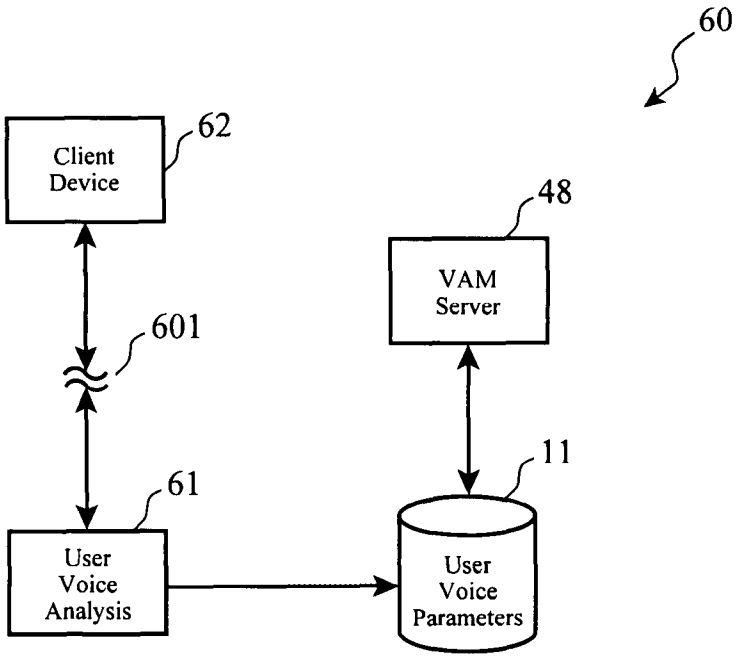
FIG. 6 illustrates the process of configuring LFO TTS voice parameters.

FIG. 6 illustrates in more detail a logical process to initialize (or update) an LFO-based embodiment. In order to initialize this embodiment of the invention, each potential sender or author of a voice-annotated IM message can use a client device of their own (62), such as a web browser device with audio recording capability or a telephone, to communicate, such as by logging into a web page or calling a voice response unit, with a voice analysis system (61). The voice analysis system may be one of several available types which generally prompt a user to speak certain words, sounds, or phrases, and then performs algorithmic analysis on those samples of speech to determine certain characteristics of the speech. For example, the analysis may yield parameters such as the harmonic content of the user's voice (e.g. main frequencies where most of the power of the voice samples is found), and the energy envelope of the user's voice (e.g. the power or sound pressure of time of each spoken word or phrase).

These parameters are then stored (11) by the user voice analyzer (61) in a data store accessible by the VAM server (48) for later use as previously described in conjunction with the delivery of a voice-annotated IM message to a receiving client device.

Figure 7:
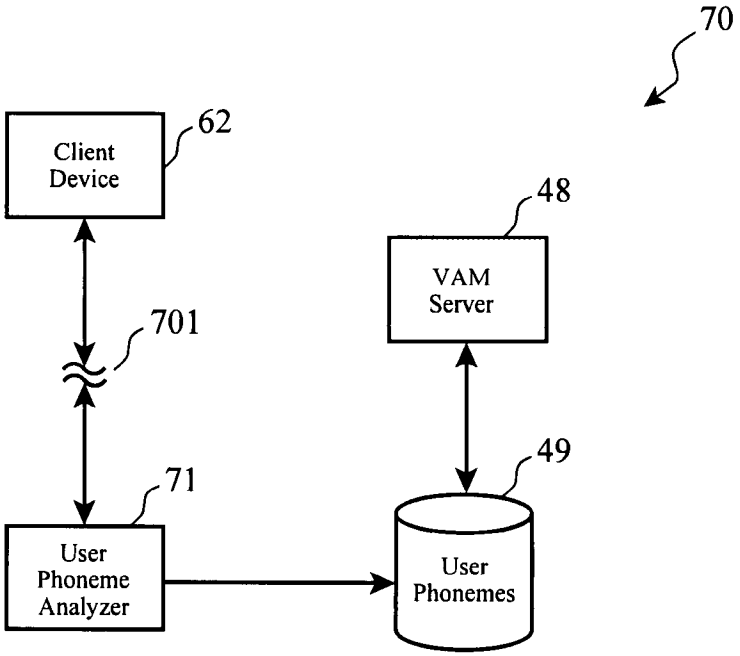
FIG. 7 depicts a process of configuring a master set of user phoneme samples.

FIG. 7 illustrates in more detail a logical process to initialize (or update) an sample-based embodiment. Similar to the initialization process for the LFO-based embodiment, this process allows the user to use a client device (62) such as an audio-enabled web browser or a telephone, to communicate (701), such as by a telephone call or by a connection to a web server, with a user phoneme analyzer (71), which may be one of several available units for the purpose. The phoneme analyzer (71) typically prompts the user to speak several phrases, words, and sounds, which are known to contain all of the phonetic units needed to recreate a full dictionary of words. Usually, the user is not required to speak all the words of the dictionary, but some specific words may be also recorded, such as the user's name.

The phoneme analyzer then extracts the phonemes from the speech samples provided by the user, and then stores the phonemes in the user phoneme database (49), which is accessible by the VAM server (48) for use during transmission of a voice-annotated IM message as previously described.

Suitable Computing Platform

The invention is preferably realized as a feature or addition to the software already found present on well-known computing platforms such as personal computers, web servers, and web browsers. These common computing platforms can include personal computers as well as portable computing platforms, such as personal digital assistants ("PDA"), web-enabled wireless telephones, and other types of personal information management ("PIM") devices.

Therefore, it is useful to review a generalized architecture of a computing platform which may span the range of implementation, from a high-end web or enterprise server platform, to a personal computer, to a portable PDA or web-enabled wireless phone.

Figure 2A:
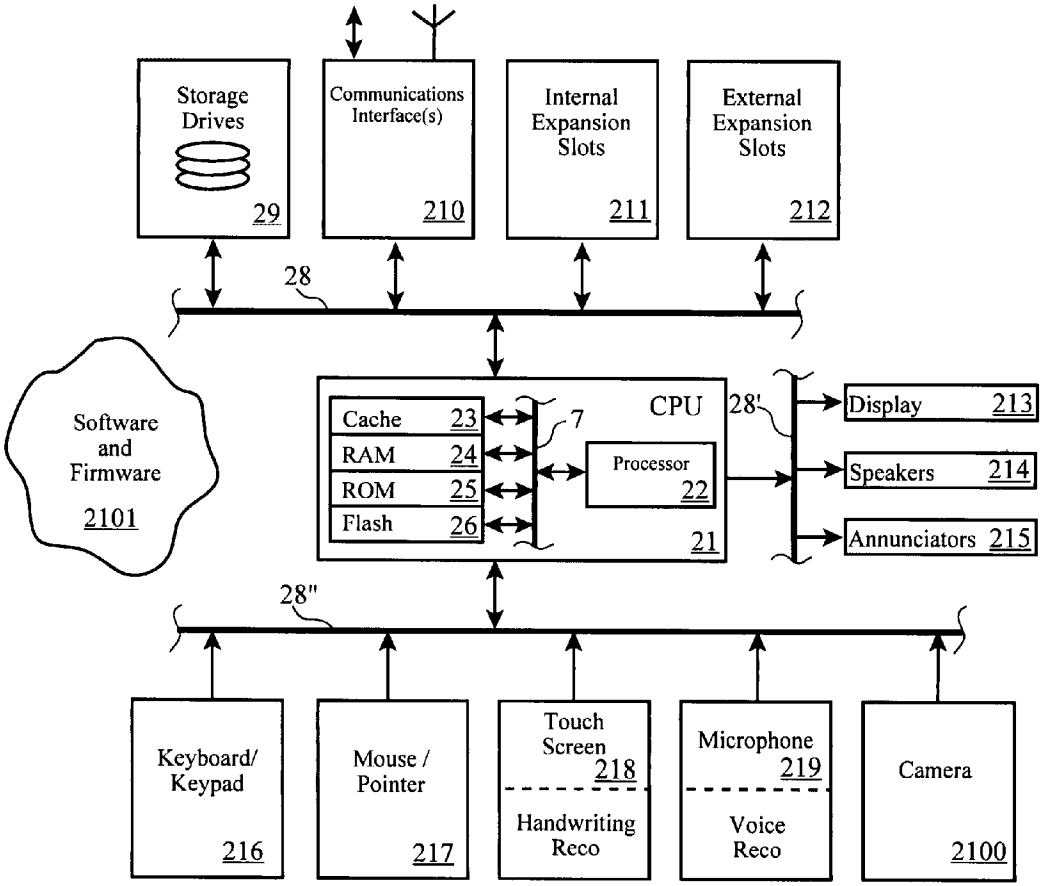
FIGS. 2*a* and 2*b* show a generalized computing platform architecture, and a generalized organization of software and firmware of such a computing platform architecture.

Turning to FIG. 2*a*, a generalized architecture is presented including a central processing unit (21) ("CPU"), which is typically comprised of a microprocessor (22) associated with random access memory ("RAM") (24) and read-only memory ("ROM") (25). Often, the CPU (21) is also provided with cache memory (23) and programmable FlashROM (26). The interface (27) between the microprocessor (22) and the various types of CPU memory is often referred to as a "local bus", but also may be a more generic or industry standard bus.

Many computing platforms are also provided with one or more storage drives (29), such as a hard-disk drives ("HDD"), floppy disk drives, compact disc drives (CD, CD-R, CD-RW, DVD, DVD-R, etc.), and proprietary disk and tape drives (e.g., Iomega Zip™ and Jaz™, Addonics SuperDisk™, etc.). Additionally, some storage drives may be accessible over a computer network.

Many computing platforms are provided with one or more communication interfaces (210), according to the function intended of the computing platform. For example, a personal computer is often provided with a high speed serial port (RS-232, RS-422, etc.), an enhanced parallel port ("EPP"), and one or more universal serial bus ("USB") ports. The computing platform may also be provided with a local area network ("LAN") interface, such as an Ethernet card, and other high-speed interfaces such as the High Performance Serial Bus IEEE-1394.

Computing platforms such as wireless telephones and wireless networked PDA's may also be provided with a radio frequency ("RF") interface with antenna, as well. In some cases, the computing platform may be provided with an infrared data arrangement ("IrDA") interface, too.

Computing platforms are often equipped with one or more internal expansion slots (211), such as Industry Standard Architecture ("ISA"), Enhanced Industry Standard Architecture ("EISA"), Peripheral Component Interconnect ("PCI"), or proprietary interface slots for the addition of other hardware, such as sound cards, memory boards, and graphics accelerators.

Additionally, many units, such as laptop computers and PDA's, are provided with one or more external expansion slots (212) allowing the user the ability to easily install and remove hardware expansion devices, such as PCMCIA cards, SmartMedia cards, and various proprietary modules such as removable hard drives, CD drives, and floppy drives.

Often, the storage drives (29), communication interfaces (210), internal expansion slots (211) and external expansion slots (212) are interconnected with the CPU (21) via a standard or industry open bus architecture (28), such as ISA, EISA, or PCI. In many cases, the bus (28) may be of a proprietary design.

A computing platform is usually provided with one or more user input devices, such as a keyboard or a keypad (216), and mouse or pointer device (217), and/or a touch-screen display (218). In the case of a personal computer, a full size keyboard is often provided along with a mouse or pointer device, such as a track ball or TrackPoint™. In the case of a web-enabled wireless telephone, a simple keypad may be provided with one or more function-specific keys. In the case of a PDA, a touch-screen (218) is usually provided, often with handwriting recognition capabilities.

Additionally, a microphone (219), such as the microphone of a web-enabled wireless telephone or the microphone of a personal computer, is supplied with the computing platform. This microphone may be used for simply reporting audio and voice signals, and it may also be used for entering user choices, such as voice navigation of web sites or auto-dialing telephone numbers, using voice recognition capabilities.

Many computing platforms are also equipped with a camera device (2100), such as a still digital camera or full motion video digital camera.

One or more user output devices, such as a display (213), are also provided with most computing platforms. The display (213) may take many forms, including a Cathode Ray Tube ("CRT"), a Thin Flat Transistor ("TFT") array, or a simple set of light emitting diodes ("LED") or liquid crystal display ("LCD") indicators.

One or more speakers (214) and/or annunciators (215) are often associated with computing platforms, too. The speakers (214) may be used to reproduce audio and music, such as the speaker of a wireless telephone or the speakers of a personal computer. Annunciators (215) may take the form of simple beep emitters or buzzers, commonly found on certain devices such as PDAs and PIMs.

These user input and output devices may be directly interconnected (28', 28") to the CPU (21) via a proprietary bus structure and/or interfaces, or they may be interconnected through one or more industry open buses such as ISA, EISA, PCI, etc.

The computing platform is also provided with one or more software and firmware (2101) programs to implement the desired functionality of the computing platforms.

Figure 2B:
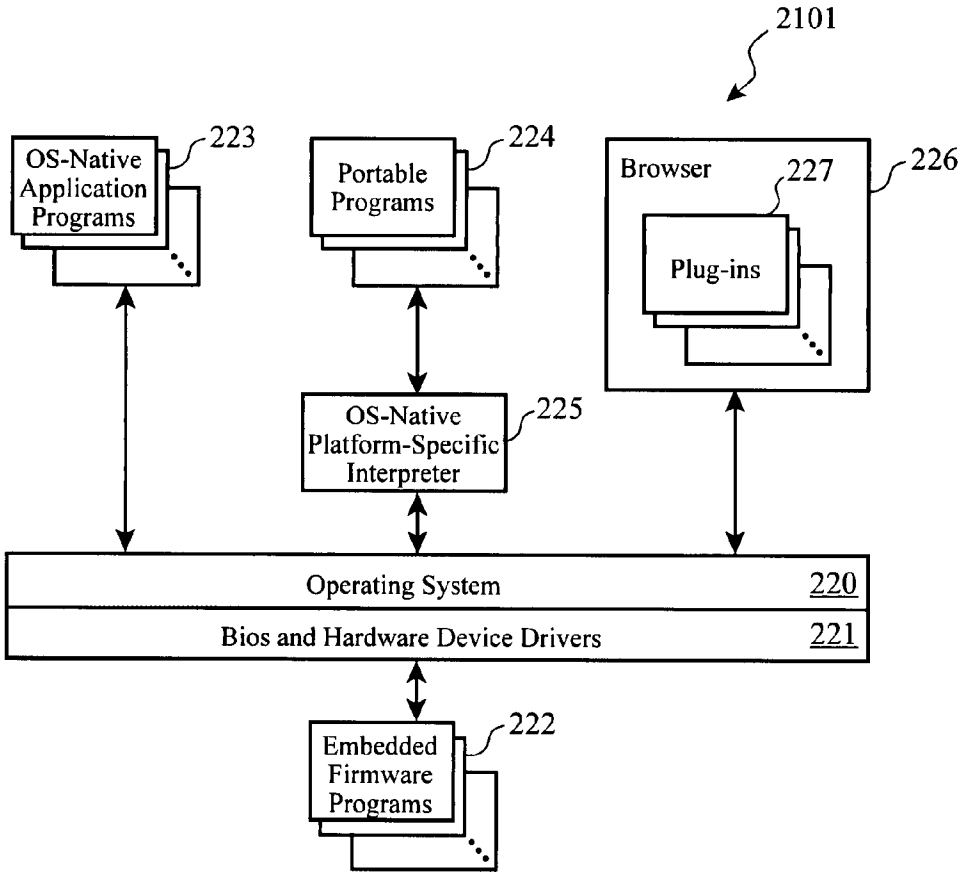

Turning to now FIG. 2*b*, more detail is given of a generalized organization of software and firmware (2101) on this range of computing platforms. One or more operating system ("OS") native application programs (223) may be provided on the computing platform, such as word processors, spreadsheets, contact management utilities, address book, calendar, email client, presentation, financial and bookkeeping programs.

Additionally, one or more "portable" or device-independent programs (224) may be provided, which must be interpreted by an OS-native platform-specific interpreter (225), such as Java™ scripts and programs.

Often, computing platforms are also provided with a form of web browser or micro-browser (226), which may also include one or more extensions to the browser such as browser plug-ins (227).

The computing device is often provided with an operating system (220), such as Microsoft Windows™, UNIX, IBM OS/2™, IBM AIX™, open source LINUX, Apple's MAC OS™, or other platform specific operating systems. Smaller devices such as PDA's and wireless telephones may be equipped with other forms of operating systems such as real-time operating systems ("RTOS") or Palm Computing's PalmOS™.

A set of basic input and output functions ("BIOS") and hardware device drivers (221) are often provided to allow the operating system (220) and programs to interface to and control the specific hardware functions provided with the computing platform.

Additionally, one or more embedded firmware programs (222) are commonly provided with many computing platforms, which are executed by onboard or "embedded" microprocessors as part of the peripheral device, such as a micro controller or a hard drive, a communication processor, network interface card, or sound or graphics card.

As such, FIGS. 2*a* and 2*b* describe in a general sense the various hardware components, software and firmware programs of a wide variety of computing platforms, including but not limited to personal computers, PDAs, PIMs, web-enabled telephones, and other appliances such as WebTV™ units. As such, we now turn our attention to disclosure of the present invention relative to the processes and methods preferably implemented as software and firmware on such a computing platform. It will be readily recognized by those skilled in the art that the following methods and processes may be alternatively realized as hardware functions, in part or in whole, without departing from the spirit and scope of the invention.

CONCLUSION

The present invention has been described, including several illustrative examples. It will be recognized by those skilled in the art that these examples do not represent the full scope of the invention, and that certain alternate embodiment choices can be made, including but not limited to use of alternate programming languages or methodologies, use of alternate computing platforms, and employ of alternate communications protocols and networks. Therefore, the scope of the invention should be determined by the following claims.

What is claimed is:

1. A method comprising:

analyzing text within a body of a first user's text instant message to determine text-to-speech synthesis control parameters that are to be used to produce a synthesized audible representation of the text within the body of the text instant message; and extracting, from text-to-speech synthesis control parameters that are associated with the first user and comprise one or more voice synthesis control parameters which determine distinctive intelligible characteristics representative of the first user, a subset of the text-to-speech synthesis control parameters associated with the first user;

wherein the text to speech synthesis control parameters are compatible with a Local Frequency Oscillator (LFO) method of voice synthesis and are to be used to produce the synthesized audible representation of the text within the body of the text instant message.

2. The method of claim 1, further comprising sending the text instant message and the subset of text-to-speech synthesis control parameters, attached to the text instant message, to a second user's device;

receiving the text instant message along with the subset of text-to-speech synthesis control parameters by the second user's device; and at the second user's device, performing text-to-speech synthesis of the text instant message implementing the subset of text-to-speech synthesis control parameters to produce the synthesized audible representation of the text within the body of the text instant message having the distinctive intelligible characteristics representative of the first user.

3. The method of claim 2, wherein receiving the text instant message along with the subset of text-to-speech synthesis control parameters by the second user's device comprises receiving the text instant message along with the subset of text-to-speech synthesis control parameters by a portable device.

4. The method of claim 1, wherein the first user is an author of the text instant message.

5. The method of claim 1, wherein extracting, from text-to-speech synthesis control parameters that are associated with the first user and comprise one or more voice synthesis control parameters which determine distinctive intelligible characteristics representative of the first user, a subset of the text-to-speech synthesis control parameters associated with the first user comprises extracting the subset from a server.

6. At least one computer-readable storage device encoded with computer-readable instructions which, when executed, causes performance of a method, the method comprising:

analyzing text within a body of a first user's text instant message to determine text-to-speech synthesis control parameters that are to be used to produce a synthesized audible representation of the text within the body of the text instant message; and extracting, from text-to-speech synthesis control parameters that are associated with the first user and comprise one or more voice synthesis control parameters which determine distinctive intelligible characteristics representative of the first user, a subset of the text-to-speech synthesis control parameters associated with the first user;

wherein the text to speech synthesis control parameters are compatible with a Local Frequency Oscillator (LFO) method of voice synthesis and are to be used to produce the synthesized audible representation of the text within the body of the text instant message.

7. The at least one computer-readable storage device of claim 6, wherein the method further comprises sending the text instant message and the subset of text-to-speech synthesis control parameters, attached to the text instant message, to a second user's device.

8. The at least one computer-readable storage device of claim 7, wherein sending the text instant message and the subset of text-to-speech synthesis control parameters, attached to the text instant message, to a second user's device comprises sending the text instant message from a portable device.

9. The at least one computer-readable storage device of claim 6, wherein the first user is an author of the text instant message.

10. The at least one computer-readable storage device of claim 6, wherein extracting, from text-to-speech synthesis control parameters that are associated with the first user and comprise one or more voice synthesis control parameters which determine distinctive intelligible characteristics representative of the first user, a subset of the text-to-speech synthesis control parameters associated with the first user comprises extracting the subset from a server.

11. A method, comprising:

receiving with a receiving device a text instant message together with one or more text-to-speech synthesis control parameters including one or more voice synthesis control parameters which determine distinctive intelligible characteristics representative of an author of the text instant message, the one or more text-to-speech synthesis control parameters representing a subset of a larger set of text-to-speech synthesis control parameters associated with the author and determining the distinctive intelligible characteristics representative of the author of the text instant message, wherein receiving with a receiving device a text instant message together with one or more text-to-speech synthesis control parameters including one or more voice synthesis control parameters comprises receiving parameters compatible with a Local Frequency Oscillator (LFO) method of voice synthesis.

12. The method of claim 11, further comprising performing text-to-speech synthesis on the text instant message with the receiving device by using the one or more text-to-speech synthesis control parameters to produce a synthesized audible representation of the text instant message having the distinctive intelligible characteristics of the author.

13. The method of claim 12, further comprising deleting the one or more text-to-speech synthesis control parameters from the receiving device subsequent to performing the text-to-speech synthesis.

14. The method of claim 11, further comprising temporarily storing the one or more text-to-speech synthesis control parameters on the receiving device.

* * * * *